United States Patent [19]

Frank

[11] 4,327,268

[45] Apr. 27, 1982

[54] CURRENT CONTROL SYSTEM FOR AN INDUCTION HEATING APPARATUS

[75] Inventor: William E. Frank, Baltimore, Md.

[73] Assignee: Westinghouse Electric Corp., Pittsburgh, Pa.

[21] Appl. No.: 154,691

[22] Filed: May 30, 1980

[51] Int. Cl.[3] ..... H05B 6/08

[52] U.S. Cl. ..... 219/10.77; 219/497; 323/280; 323/281; 307/562; 307/362; 330/110

[58] Field of Search ..... 219/10.77, 10.75, 497, 219/482, 488, 489; 323/280, 281; 307/362, 237, 546, 547, 549, 551, 562, 565, 563; 330/110; 328/127, 128, 169, 171

[56] References Cited

U.S. PATENT DOCUMENTS

| | | | |
|---|---|---|---|
| 3,094,675 | 6/1963 | Ule | 330/110 |
| 3,566,151 | 2/1971 | Wilburn | 219/497 X |
| 3,686,460 | 8/1972 | Lamparter et al. | 219/10.77 |
| 3,718,852 | 2/1973 | Bailey | 219/10.77 X |
| 3,746,825 | 7/1973 | Pfaffmann | 219/10.77 |
| 3,778,794 | 12/1973 | Szabo et al. | 328/127 |

*Primary Examiner*—B. A. Reynolds
*Assistant Examiner*—Philip H. Leung
*Attorney, Agent, or Firm*—C. M. Lorin

[57] ABSTRACT

Coil current loading the induction coils of an induction heating apparatus is directly sensed at the input from the tank circuit and the derived feedback current signal is used to control the power supply to the tank circuit be reference to a signal provided manually or automatically under process control. A voltage feedback signal is derived with a transformer from the input to the tank circuit for providing an input to a voltage limiter operative on the current controller when the voltage to the tank circuit exceeds an acceptable limit. A current limiter overrides the current controller to limit the load current by control of the current controller when the load becomes excessive.

1 Claim, 1 Drawing Figure

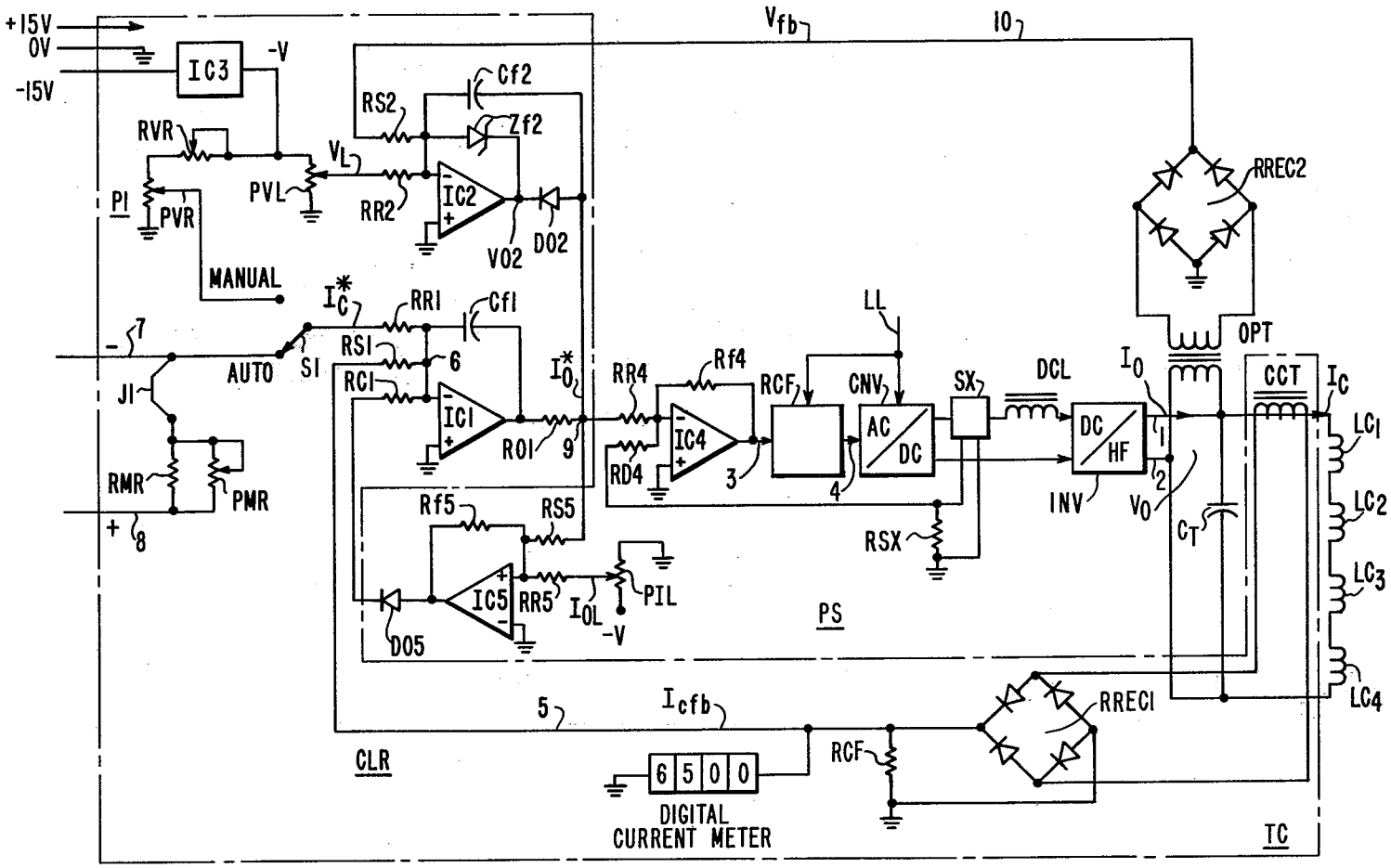
RREC2
OPT
CCT
$I_C$
$LC_1$
$LC_2$
$LC_3$
$LC_4$
IC
$C_T$
$I_0$
$V_0$
DC
HF
INV
DCL
SX
AC
DC
CNV
LL
RSX
RCF
Rf4
IC4
RR4
RD4
PS
RREC1
RCF
$I_{cfb}$
DIGITAL CURRENT METER
PIL
$I_{OL}$
-V
RS5
RR5
IC5
Rf5
DO5
CLR
$I_0^*$
RO1
IC1
Cf1
RR1
RS1
RC1
$I_C^*$
S1
AUTO
MANUAL
PMR
RMR
J1
Cf2
Zf2
DO2
VO2
IC2
RS2
RR2
$V_L$
PVL
-V
IC3
RVR
PVR
PI
Io
Vfb
+15V
0V
-15V

CURRENT CONTROL SYSTEM FOR AN INDUCTION HEATING APPARATUS

BACKGROUND OF THE INVENTION

The invention relates to high frequency induction heating in general and, more particularly, to induction heating apparatus having an improved capability for heat treatment of workpieces under controlled conditions of temperature, power density and/or frequency.

An induction heating apparatus conventionally includes a tank circuit fed with energy oscillating at the desired frequency and a coil applied to the workpiece for generating therethrough a high frequency electromagnetic field inducing active secondary currents into the workpiece under heat treatment.

Control of the induction heating apparatus is essential for an efficient operation and for adapting the existing equipment and power supply to a wide range of workpieces of different shape, geometry, and material.

A customary approach with induction heating apparatus has been to control the voltage, or the power applied to the coil circuit from the electrical power source. These methods have not been satisfactory because the final temperature for the workpiece treated is never obtained with sufficient precision for automatic control and manual adjustment has been required in general.

Where the final temperature is critical, the prior art has made use of closed loop feedback control by direct comparison of the actual temperature with the desired temperature as a reference. In such case, an error signal is generated which cases a change in the power supply.

Instead of controlling the power supply in regard to temperature, magnetic forces have also been used as the controlling parameter, but this requires a strict and precise control of the current passing through the induction coil for any quality standard by heat treatment to be achieved.

An object of the present invention is to provide coil current control in an induction heating apparatus.

The invention rests on the observation that neither the voltage, nor the power supplied to the tuned tank circuit is in direct relationship to the coil current.

Thus, for voltage control the coil current $I_C$ is given by the equation:

$$|I_C| = \frac{Vo}{\sqrt{R^2 + \left(\frac{f}{f_o}\right)^2 \frac{L}{C}}} \quad (1)$$

where

L=coil inductance;

C=tuning capacitor;

Vo=coil voltage;

R=coil resistance;

f=driving frequency;

$f_o$=resonant frequency of coil and tuning capacitors.

For power control, the coil current $I_C$ is given by the equation:

$$I_C = \frac{Po}{\sqrt{R^2 + \left(\frac{f}{f_o}\right)^2 \frac{L}{C}}\ I_o \cos\phi} \quad (2)$$

where, in addition to the parameters of equation (1),

Po=power applied to the tank circuit under Vo and $I_o$;

$I_o$=current fed to the tank circuit;

$\phi$=phase angle between current $I_o$ and voltage Vo.

It appears that, in both instances, the coil current $I_C$ is dependent upon the driving frequency from the power supply as well as upon the impedance of the coil. Since all the aforementioned parameters are susceptible of varying during the heating process, a precise control cannot be achieved with either of these methods.

Accordingly, an induction heating apparatus has been conceived combining means for sensing the coil current directly and a closed loop for controlling the power supply in response to such sensing means.

Typically, the power supply is a static frequency converter, although it could be of the motor-generator type, an AC line power controller, a magnetic frequency multiplier, or a radio frequency generator, for instance.

Nevertheless, current control of heating induction apparatus gives rise to problems which are due to the nature of the heat treatment with this kind of apparatus. Whenever a workpiece is taken away from the tank an abrupt change of impedance takes place as seen by the active induction coils. This results in the control system calling for too much voltage. On the other hand, for a given setting of the control system the new workpiece might cause the system to abruptly call for too much power, which leads to an excessive current being drawn from the power supply.

SUMMARY OF THE INVENTION

Induction heating apparatus of the current control type according to the present invention is characterized by operation in three different modes automatically selected under changing operating conditions:

(1) Normal "in-range" coil current control by which the coil current controller controls the power supply to operate within its rated voltage (Vo) and current ($I_o$) levels;

(2) Abnormal "out-of-range" voltage limit control whenever the voltage demanded by the tank circuit exceeds the voltage rating (Vo) of the power supply; and (3) Abnormal "out-of-range" current limit control whenever the current demanded by the tank circuit exceeds the current rating ($I_o$) of the power supply.

BRIEF DESCRIPTION OF THE DRAWINGS

The FIGURE shows the coil current control system of the induction heating apparatus according to the invention.

DESCRIPTION OF THE PREFERRED EMBODIMENT

Referring to the FIGURE, the induction heating apparatus according to the invention generally includes a tank circuit TC, a power supply PS and a power supply controller CLR.

The tank circuit includes the user's load induction coils and series connected capacitors for tuning with the load coils. The coil current sensing means preferably consists in a coil current measuring transformer such as described in copending patent application Ser. No. 154,692 filed May 30, 1980, e.g., concurrently. The copending patent application is hereby incorporated by reference. This coil current measuring transformer provides a linear and accurate representation of the coil current.

The tank circuit typically comprises four induction coils $LC_1$–$LC_4$ in series and tuning capacitors symbolized by a capacitor $C_T$. Current $I_C$ loading the coils is sensed by the coil current measuring transformer CCT.

The power supply, typically, is a static converter controlled by thyristors. Alternating current power from power lines LL is converted to direct current by an AC/DC converter CNV which is coupled through a DC link to an inverter INV converting DC to high frequency AC supplied on lines 1 and 2 to the tank circuit. While current $I_C$ drawn from the tank circuit is sensed by measuring transformer CCT, voltage Vo applied between input lines 1 and 2 of the tank circuit is measured by a transformer OPT.

After rectification by an associated rectifier bridge, a rectified current feedback signal $I_{Cfb}$ is derived from the coil current measuring transformer CCT and in the same fashion a rectified voltage feedback signal $v_{fb}$ is derived from transformer OPT. These two feedback signals are used by the power supply controller CLR as will be seen hereinafter.

The power supply controller CLR applies on line 3 a control signal to the rectifier controller RCF which generates on line 4 gate control signals for the thyristors of the AC/DC converter CNV, as generally known.

The power supply controller CLR includes an operational amplifier ICI mounted as an integrator with a capacitor Cfl in its feedback loop between output and inverting input. The non-inverting input is connected to ground. The derived current feedback signal $I_{Cfb}$ on line 5 is applied to the inverting input, via a resistor RS1, at a summing point 6 also connected to capacitor Cfl. A current reference signal $1_C$* is also applied to junction 6 via a resistor RR1. Current reference signal $1_C$* can be derived from a manually adjustable reference potentiometer P1 inserted between a reference potential −V, a potentiometer RVR and ground. Reference potential −V is obtained from an operational amplifier IC3 used as a reference and supplied from a −15 volts local source. Current reference signal $I_C$* may also be automatically provided from a process control circuit generating a signal input applied as reference signal $I_C$* when interrupter S1 is in position AUTO. The opposite position MANUAL is used when the manual reference potentiometer P1 is used. Then, the arms PVR and RVR can be adjusted by the operator.

In the Auto position of interrupter S1, a jumper J1 may be connected through parallel resistors RMR and PMR connected between positive and negative input leads 7, 8 from the process controller (not shown). As a result, a DC current signal selected for the range of 4–20 ma, 0–5 ma, etc. is derived which is a DC reference voltage scaled to the average value of the rectified feedback coil current signal $I_{Cfb}$ of lead 5. Resistor PMR is a vernier potentiometer associated with resistor RMR, and together they establish a current/voltage characteristic which allows to supply a current signal from the process controller which matches the required reference signal $1_C$* in relation to the current feedback signal $I_{Cfb}$ of line 5. If, however, a voltage signal is desired, the jumper J1 is removed, and the expected reference voltage signal is derived between DC lines 7 and 8.

Accordingly, for the Auto position of switch S1, during normal "in-range" coil current control, the difference between $I_C$* and $I_{Cfb}$ is integrated through operational amplifier IC1 to nearly zero error ($I_{Cfb}=1_C$*) so that the desired coil current is achieved on command from the process controller reference signal. The overall scaling of the coil current loop is $$I_C = \frac{\pi}{2\sqrt{2}} N_{CCT} \frac{I_C^*}{RCF} \tag{3}$$

where:

$I_C$=RMS coil current in primary of CCT $I_C$*=Coil current reference signal (DC volts)

RCF=I/V conversion resistor in DC output of current transducer (ohms)

$N_{CCT}$=Turns ratio of CCT.

The output($I_o$*) of the coil current controller is at junction 9 between output resistor RO1 of IC1 and input resistor RR4 of amplifier IC4 to the power supply PS. The control signal $1_o$* sets the level of power supply demanded by the tuned load, i.e.

$$Vo = I_C \cdot Z_c \tag{4}$$

$$I_o = Po/(PF \cdot I_C \cdot Z_c) \tag{5}$$

where

Vo=RMS output voltage of power supply $I_o$=RMS output current of power supply

Po=output power of power supply $Z_c$=impedance of the series connected load coils PF=power factor of the load.

It is necessary for a successful operation of the coil current control system that provision be made for a fast "in-control" voltage limiter. Under normal control Vo is forced to assume the value required to maintain $I_C$ at the desired level. As a result should Vo not be limited when $I_C$ or $Z_c$ takes a value exceeding the normal demand, the system would become unstable. To prevent this from happening, an operational amplifier IC2 is provided which is mounted as an integrator with a capacitor Cf2 in its feedback loop between output and inverting input. A Zener diode Zf2 is mounted between the output and the inverting input of IC2. A steering diode D02 is mounted between the output of IC2 and junction 9. Operation amplifier IC2 performs a dual purpose. First, it operates as a high speed comparator until the voltage limiting function becomes necessary. Secondly, it works as a differential error integrator when it is in the voltage limiting mode. The voltage limit reference $V_L$* is provided from the local potential source −V derived at the output of IC3. It is adjustable by a vernier potentiometer PVL. Signal $V_L$* is applied via a resistor RR2 to the inverting input of IC2, while rectified feedback signal $V_{fb}$, on line 10 from voltage measuring transformer OPT, is applied to IC2 via resistor RS2. During normal "in-range operation, $V_L^* > V_{fb}$. In such case, the output Vo2 of IC2 is positive since it is held by Zener diode Zf2 at a voltage $Vf2 > 1_o$*. At this time steering diode DO2 is back biased, thereby disconnecting IC2 from junction 9, e.g. from $1_o$*. Under such circumstances, coil current control is performed by IC2 as earlier explained. Also, under the same circumstances the voltage of feedback capacitor Cf2 is identical to $I_o$* since the right plate of Cf2 is connected to junction 9 and the left plate of Cf2 is held to virtual ground at the inverting input of operational amplifier IC2 under the feedback action of Zf2. In this manner, Cf2 is ready to provide feedback integrating action to the inverting input of IC2 whenever steering diode DO2 becomes forward biased. When Vfb attempts to exceed $V_L$*, Vo2 slews down rapidly to $1_o$*, being only limited by the slew rate of IC2, and diode DO2 becomes forward biased, thereby transferring the operational amplifier IC2 into the abnormal "out-of-range" voltage limit control mode. In fact, diode DO2 switches-in both operational amplifier IC2 and capacitor Cf2 so that the voltage controlling integrator function of IC2 takes over from the current controlling integrator function of IC1. Now, the difference between $V_L$* and $V_{fb}$ is integrated to nearly zero with the output voltage being held in limit at $$Vo = \frac{\pi}{2\sqrt{2}} N_{opt} V_L^* \text{ volts RMS} \quad (6)$$

where $N_{opt}$=turns ratio of transformer OPT.

The power supply controller also provides for limiting the reference signal $1_o$* to a limit value IoL whenever the power supply current $I_o$ tends to reach an unacceptable level. To this effect, an operational amplifier IC5 is connected between an adjustable current source providing a limit signal IoL from a potentiometer PIL connected between voltage −V and ground. Such current is fed via resistor RR5, a diode DO5, and input resistor RC1 to junction 6 of IC2. From junction 9, $I_o$* is supplied via resistor RS5 to IC5 as parallel input. The output circuitry for the current limit circuit is part of the power supply PS. It includes a current transducer SX in the DC link and a filtering reactor DCL. The sensed value from transducer SX is fed back via a resistor RD4 to amplifier IC4 which already receives $I_o$* via resistor RR4.

The current through transducer SX is $I_o$. Amplifier IC4, rectifier controller RCF, phase controlled rectifier CNV and current transducer SX form an inner control loop such that:

$$I_o = NSX(I_o^*/RSX) \quad (7)$$

where

NSX=turns ratio of transducer SX;

RSX=I/V sensing resistor in the output of transducer SX.

In normal operation, $I_o$ satisfies the load requirement in accordance with equation (5), while $1_o$* takes on the value necessary to meet equation (7). At the same time, normally IoL>$I_o$*. Therefore, diode DO5 is back biased so as to disconnect the output of IC5 from the summing resistor RC1 into IC1. Should, however, $I_o$ tend to take an excessive value, $1_o$* reaches the threshold IoL. At this moment the output of IC5 switches state. It follows that IC5 becomes connected to IC1 via DO5 and RC1. A high gain inner loop is thus formed around IC1 holding $1_o$* and, accordingly, $I_o$ to the prescribed limit level.

I claim:

1. In an induction heating apparatus having induction coil means supplied with high frequency high power current from a tank circuit energized under a voltage supplied by a power generator; the combination of:

means for sensing coil current drawn by said induction coil means from said tank circuit;

first feedback means responsive to said current sensing means for deriving a coil current feedback signal;

current controller means normally responsive to said coil current feedback signal for applying to said power generator a control signal for adjusting said coil current;

second feedback means responsive to the voltage applied by said power generator to said tank circuit for deriving a voltage feedback signal;

a steering diode; and voltage limited means operative in a comparator mode in response to said voltage feedback signal and a reference voltage signal for backbiasing said steering diode until said supplied voltage exceeds a predetermined critical voltage determined by said reference voltage signal;

with said voltage limiter means forward biasing said steering diode when said predetermined critical voltage has been exceeded; and with said steering diode, when forward biased, transferring said voltage limiter means into an integrator mode for limiting the operation of said current controller means, thereby to prevent excessive voltage from said power generator.

* * * * *